US011333423B2

(12) United States Patent
Skomsøy et al.

(10) Patent No.: US 11,333,423 B2
(45) Date of Patent: May 17, 2022

(54) ARRANGEMENT FOR ACCUMULATION AND EVACUATION OF DEFROSTING AND CONDENSATION WATER FROM REFRIGERATION AND COOLING UNITS

(71) Applicant: JETS AS, Hareid (NO)

(72) Inventors: Jan Helge Skomsøy, Ålesund (NO); Werner Dybvik, Langevåg (NO); Tor Rønnestad, Ålesund (NO)

(73) Assignee: JETS AS, Hareid (NO)

( * ) Notice: Subject to any disclaimer, the term of this patent is extended or adjusted under 35 U.S.C. 154(b) by 270 days.

(21) Appl. No.: 16/466,399

(22) PCT Filed: Feb. 27, 2018

(86) PCT No.: PCT/NO2018/000006

§ 371 (c)(1),
(2) Date: Jun. 4, 2019

(87) PCT Pub. No.: WO2018/174719

PCT Pub. Date: Sep. 27, 2018

(65) Prior Publication Data

US 2020/0080764 A1 Mar. 12, 2020

(30) Foreign Application Priority Data

Mar. 23, 2017 (NO) ..... 20170477

(51) Int. Cl.
*F25D 21/14* (2006.01)
*F24F 13/22* (2006.01)
(Continued)

(52) U.S. Cl.
CPC ..... *F25D 21/14* (2013.01); *F24F 13/222* (2013.01); *F28B 9/08* (2013.01); *F28F 17/005* (2013.01); *F25D 2321/144* (2013.01)

(58) Field of Classification Search
CPC .. F25D 2321/144; F25D 21/14; F24F 13/222; F28B 9/08; F28F 17/005
See application file for complete search history.

(56) References Cited

U.S. PATENT DOCUMENTS 5,562,003 A * 10/1996 Lefebvre ..... F28B 9/08 73/308
5,664,430 A * 9/1997 Karman ..... F24F 13/22 62/285

(Continued)

FOREIGN PATENT DOCUMENTS

CN 1662196 A 8/2005
DE 102010039576 A1 2/2012

(Continued)

OTHER PUBLICATIONS

International Search Report and Written Opinion of the International Searching Authority dated May 31, 2018 in corresponding International application No. PCT/NO2018/000006; 6 pages.

(Continued)

*Primary Examiner* — Lionel Nouketcha
(74) *Attorney, Agent, or Firm* — Maier & Maier, PLLC

(57) ABSTRACT

Arrangement for accumulation and evacuation of water such as defrosting and condensation water from refrigeration units, the system including a piping arrangement with a vertical pipe section extending from a water evacuation unit provided in conjunction with the respective refrigeration unit; discharge valves, one for each unit; one or more liquid reservoir for each unit; one or more vacuum pumps; air inlet nozzles; a control unit; one or more level switches and air conduit inlet opening for each vertical pipe. Each of the water evacuation units includes a docking station and a water collection tray preferably to be slideably provided within the docking station, whereby each unit is custom (Continued)

made to fit between the refrigeration unit and floor where the refrigeration units are placed.

18 Claims, 3 Drawing Sheets

(51) Int. Cl.
*F28B 9/08* (2006.01)
*F28F 17/00* (2006.01)

(56) References Cited

U.S. PATENT DOCUMENTS

| | | | | |
|---|---|---|---|---|
| 6,305,403 | B1 * | 10/2001 | von Palffy | E03F 1/006 137/205 |
| 8,869,548 | B2 * | 10/2014 | Piccione | F24F 13/222 62/291 |
| 2008/0078197 | A1 * | 4/2008 | Jang | F25D 21/14 62/285 |
| 2012/0151953 | A1 * | 6/2012 | Timbs | F24F 13/222 62/291 |
| 2014/0130529 | A1 | 5/2014 | Kaiser et al. | |

FOREIGN PATENT DOCUMENTS

| | | | |
|---|---|---|---|
| EP | 0287350 | A2 | 10/1988 |
| EP | 1085134 | A2 | 3/2001 |
| EP | 1403590 | A1 | 3/2004 |
| EP | 2636966 | A1 | 9/2013 |
| JP | H06-129755 | A | 5/1994 |
| JP | H10-281627 | A | 10/1998 |
| WO | 9010123 | A1 | 9/1990 |

OTHER PUBLICATIONS

European Search Report dated Mar. 3, 2020, in corresponding European application No. 18771011.6; 12 pages.

Jets, "Jets Vacuum Systems for supermarkets—simpler condensate water transport", Sanitary Systems—made to please, May 2, 2015, XP055667990, total 8 pages. Retrieved from the Internet: URL:https://web.archive.org/web/2017010118 3645if /http://standard.jetsgroup.com/en/Sanitary-systems/-/media/ACE3E889582342F398BDF5C49D274DFD.ashx [retrieved on Dec. 12, 2020].

Chinese Office Action dated Sep. 2, 2020, in connection with corresponding CN Application No. 201880019453.5 (13 pp., including machine-generated English translation).

"Sanitary systems—made to please," Jets Sanitary Systems for Any Ship, May 2, 2015. 32 pages.

* cited by examiner

A (1:5)

ARRANGEMENT FOR ACCUMULATION AND EVACUATION OF DEFROSTING AND CONDENSATION WATER FROM REFRIGERATION AND COOLING UNITS

The present invention relates to a arrangement in a system for accumulation and evacuation of water such as defrosting, condensation and cleaning water from refrigeration and cooling units. The system includes a reservoir, tank or container holding an amount of liquid, a piping arrangement and a vacuum pump and a control device to start and stop the vacuum pump.

Such systems have been increasingly used for the evacuation of condensed water from refrigeration and cooling units in warehouses and stores where drainage in the floor is not available. The condensed water is instead "lifted" in a vertical pipe from a water tank provided in conjunction with the refrigeration or cooling unit to a piping arrangement provided in the ceiling above such unit and further to a vacuum pump provided in an available machine room or other suitable room in the subject warehouse. The pumps commonly used in such systems are liquid ring screw pumps, with or without a macerator as further described below, which can handle liquid containing particles that may be ground to smaller pieces. Pumps of this kind are commonly used in vacuum sewage systems on board ships and on offshore installations. However, such systems are also increasingly being used on land due to reduced water requirement and easy handling and treatment of waste water, as well as its flexibility as regards installation of piping and layout given by such systems.

The applicant of the present application introduced in 1986, cf. EP patent No. 0 287 350, for the first time the novel vacuum sewage system where the vacuum in the system was generated by means of a liquid ring screw pump of this kind and where the pump is used as well to discharge the sewage from a vacuum tank or the like to which it is connected.

EP patent No. 0 454 794, also filed by the applicant, further shows a revolutionary improvement of a vacuum sewage system where the liquid ring screw pump is provided with a grinder or macerator and is connected directly with the suction pipe of the system, whereby vacuum is generated in the sewage suction pipe and sewage is discharged directly from the system by means of the pump.

The present invention may, or may not, include such grinder provided at the inlet end of the Archimedes screw rotor.

As stated above, vacuum systems have been increasingly used for the evacuation of condensed water from refrigeration units in warehouses and stores where drainage in the floor is not available. The vacuum in such systems is normally between 60 and 50 kPa (40 and 50% below atmospheric pressure), implying that the condensed or defrosted water having a density of 1 kg/dm$^3$ is lifted 4-5 meters at a maximum. With the present solution, the water may be lifted twice the height, i.e. 8-10 meters with the same vacuum by letting air into the suction pipe as explained in a later section. Thus, it is possible to evacuate condensed water in warehouses where the height from the floor to the ceiling is doubled. However, due to the narrow space between the individual refrigeration unit and the floor it has been a challenge to exploit this evacuation principle. The height between the floor and bottom of the modern refrigeration units is just 5-7 centimetres and therefore it has been difficult to obtain sufficient space for a container to collect the condensed water. With the present invention is provided an arrangement making it possible to evacuate condensed water and defrosting water effectively using the "floor to ceiling evacuation principle".

The arrangement according to the invention is characterized by the features as defined in the attached independent claim 1.

Advantageous embodiments of the invention are further defined in the attached dependent claims 2-7.

The invention will be further described in the following by way of example and with reference to the enclosed figures, where;

Figure 1:
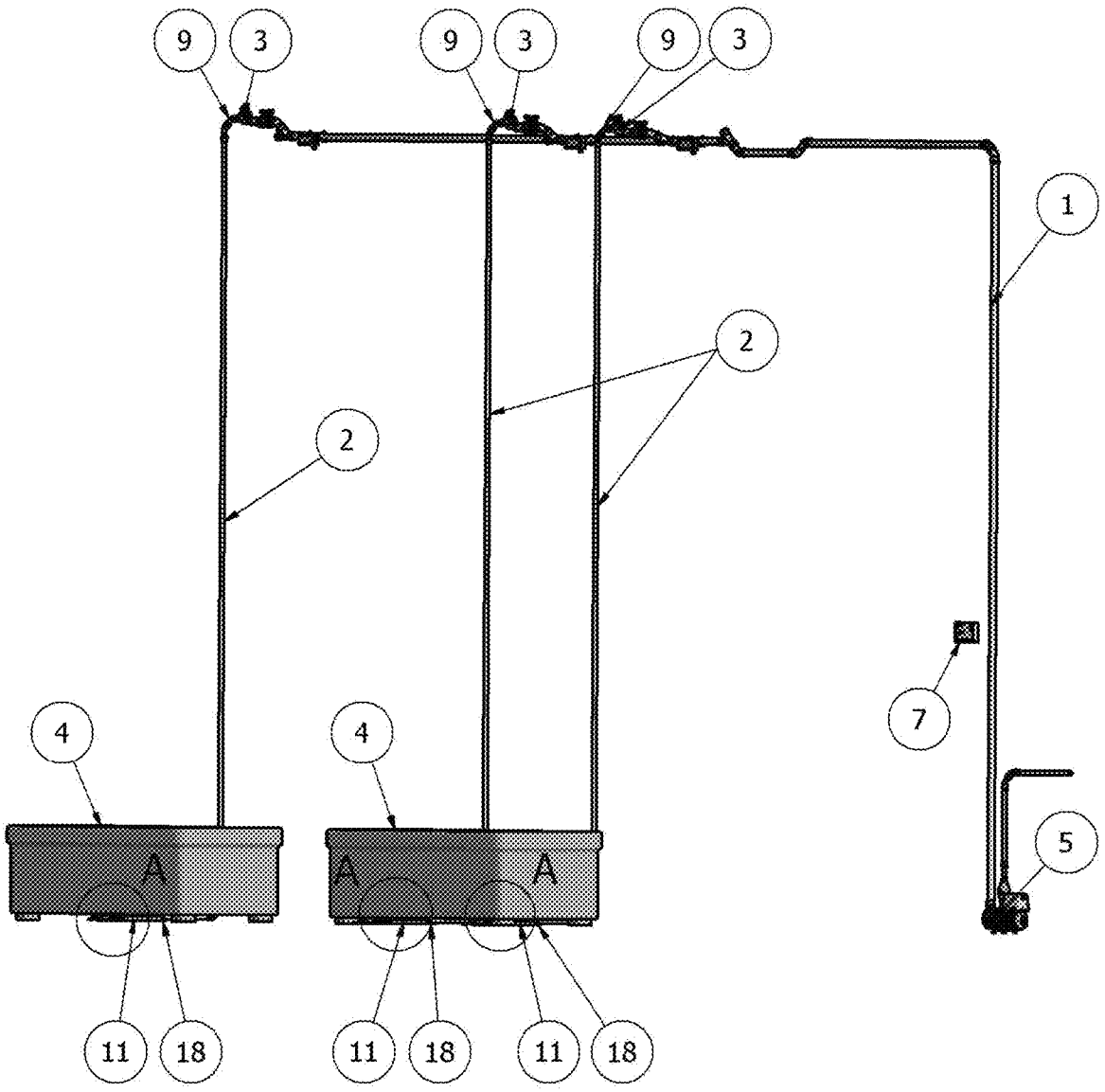
FIG. 1 illustrates an example of a system for removal of water from refrigeration or cooling units including the arrangement according to the invention.

FIG. 1 shows, as stated above, a system according to the invention for removing defrosting water or condensed water from refrigeration or cooling units 4 and/or grey water (cleaning water) from the cleaning of such refrigeration or cooling units 4 in warehouses. The system includes a piping arrangement (a pipe loop) 1 with a vertical pipe section 2 extending from each water evacuation unit provided in conjunction with the respective refrigeration or cooling unit 4; discharge valves 3, one for each water evacuation unit; water collection tray 11 (see FIG. 4) for each water evacuation unit; a vacuum pump 5; air inlet nozzles 6 (see FIG. 4); a control unit 7; water level sensors or switches 8 and 10 (see FIG. 4), and air conduit inlet opening 9 for each vertical pipe section 2. There may be one or more water evacuation units for each refrigeration or cooling unit 4.

Figure 2:
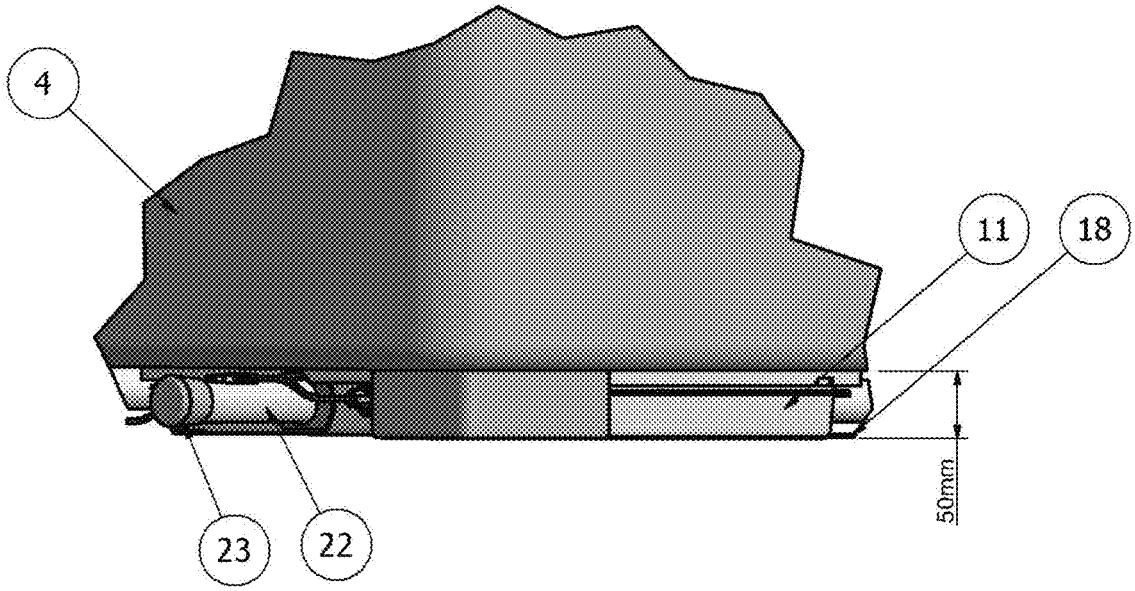
FIG. 2 shows a section denoted A in scale 1:5 of a water evacuation unit according to the invention.
Figure 3:
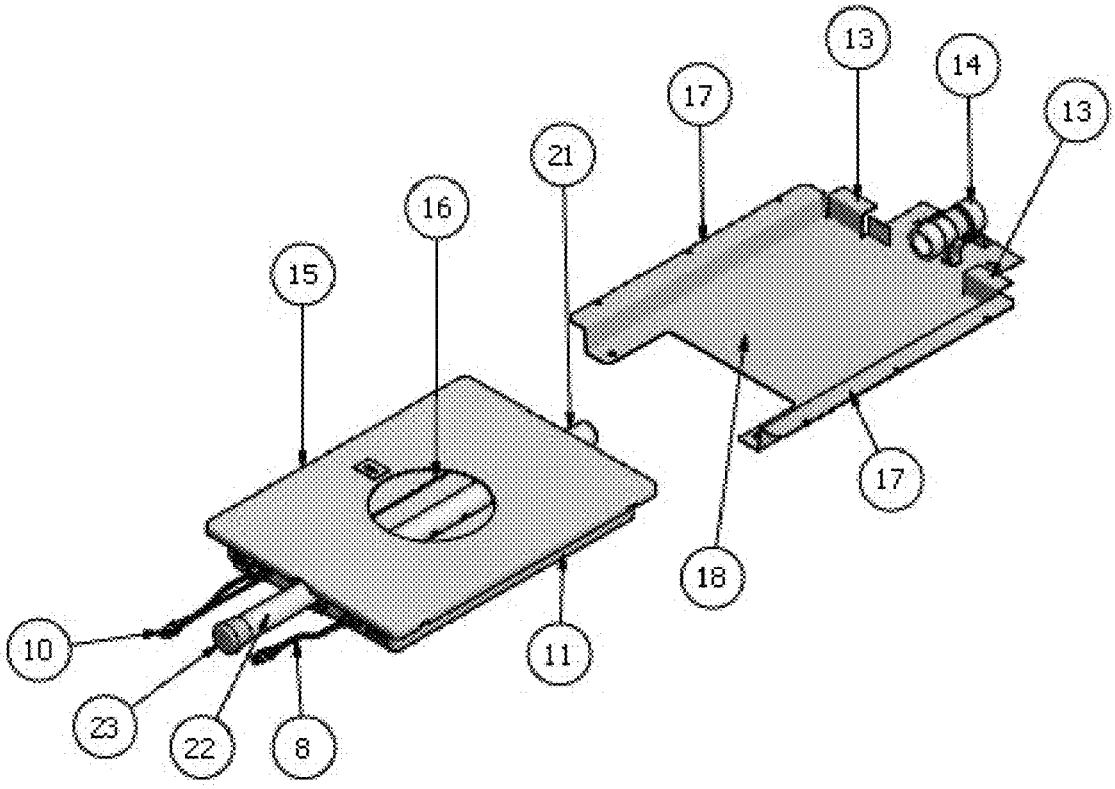
FIG. 3 shows the water evacuation unit in FIG. 2 as such in expanded view and in more detail.
Figure 4:
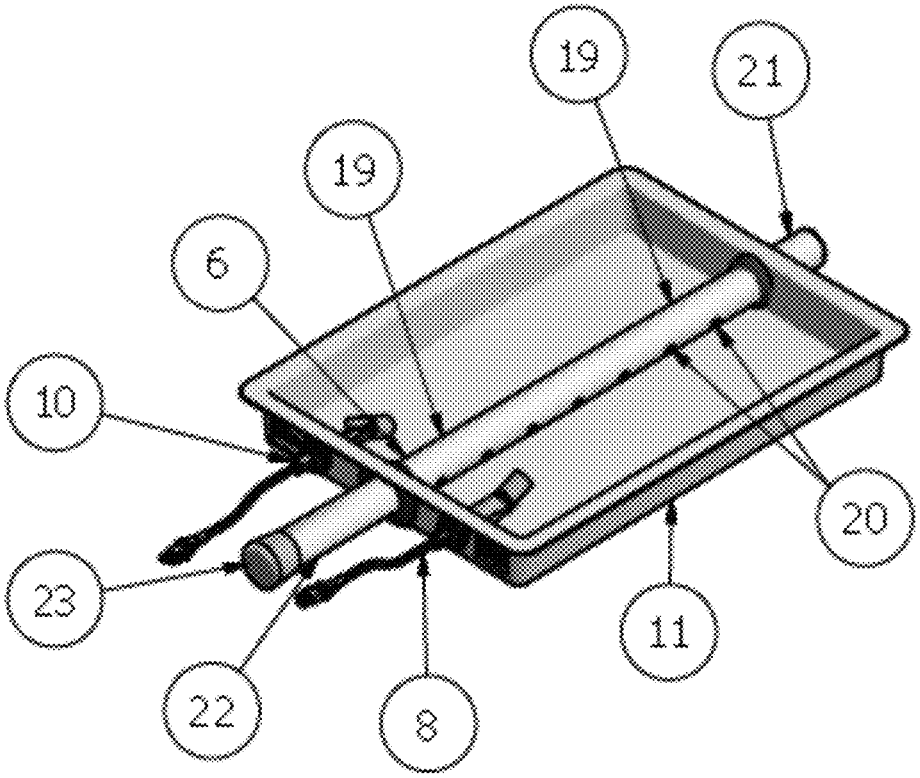
FIG. 4 shows a water collection tray as part of the unit in FIGS. 1 and 2 in more detail.

The main features of the invention are further shown in FIGS. 2, 3 and 4 and includes the water evacuation unit in combination with a water tapping control regime with frequent emptying of water from each evacuation station as described below. Referring to FIGS. 2-4. The section denoted A of the water evacuation unit shown in FIG. 2 includes a docking station 18 and a water collection tray 11 to be slideably provided within the docking station 18. By using a docking station 18 and water collection tray 11 as here described, the water collection tray 11 may be positioned under the refrigeration or cooling unit 4 in a simple and safe manner and may as well be easily withdrawn for cleaning or maintenance. This is required since the water collection tray 11 and docking station 18 have a very low building height to fit between the floor and the refrigeration or cooling unit 4. Each docking station 18 may be made of a suitable material such as a metal plate material, being bent upwards on each side and end portion, forming upwardly protruding guide members 17 and end stoppers 13 for the water collection tray 11. At the end of the docking station 18, between the end stoppers 13, is provided a suction pipe connection 14 to be sealingly connected at its outer end to the vertical pipe section 2. The water collection tray 11 may either be fastened to the refrigeration or cooling unit via horizontal flanges on the upwardly protruding guide members 17 or fastened to the floor, preferably by gluing.

The water collection tray 11 is provided with a lid 15 having an opening 16, through which the water enters from the water drainage opening (not shown) of the respective refrigeration or cooling unit 4.

FIG. 4 shows the water collection tray 11 in more detail. A water drainage pipe 19 is provided in the longitudinal direction of the water collection tray and is extending through each of the water collection tray ends. The inner end 21 is provided to fit sealingly into the suction pipe connection 14 when being docked in its docking station 18 underneath the refrigeration or cooling unit 4. The outer end 22 of the water drainage pipe 19 is sealed with a cap 23. This outer pipe end 22 may serve two purposes: a) it may be used to interconnect two or more water collection trays 11 in parallel by means of a parallel piping arrangement (not shown in the figures), and b) it may be used as a handle when positioning the water collection tray 11 under or taking it out from the docking station underneath the refrigeration or cooling unit 4. This is just a practical design issue. The water collection tray 11 may of course, instead of the outer pipe end 22, be equipped with a separately provided handle. Along the water drainage pipe 19 on the side facing the bottom of the water collection tray 11 and within the length of the water collection tray 11, drainage holes or openings 20 are provided through which the water is drained (under operation of the system). The number of holes 20 along the entire length of the water collection tray 11 ensures complete emptying of the water collection tray 11. To further ensure complete emptying, the bottom of the water collection tray 11 may be tilting downwards from the upwardly protruding guide members 17 towards the water drainage pipe 19. The water collection tray 11 is further, as stated above, provided with a water level sensor or switch 10 to start and stop the vacuum pump 5. As a preferred embodiment the water collection tray 11 may also be provided with an additional water level sensor or switch 8 which will start the vacuum pump 5 and initiate an alarm (not shown) in case the first water level sensor or switch 10 fails to work. It is important to understand that the docking station may have a design differing from the one described above where the water collection tray 11 is guided by upwardly protruding guide members 17 and end stoppers 13 to position the water collection tray 11 underneath the refrigeration or cooling unit 4. Thus, the docking station may for instance be formed like V-shaped guide members provided in conjunction with the suction pipe connection 14, whereby the end of the suction pipe 21 of the water collection tray 11 may be guided by the V-shaped guides towards the suction pipe connection 14 when being placed underneath a refrigeration or cooling unit 4.

The system as shown in the figure is normally used and operated in two different modes, intermittently or continuously as described in the following. In small installations, were there is only one or a few number of water or grey water sources, intermittent running of the vacuum pump is normally most suitable, Water from a refrigeration unit (not shown in the figure) is accumulated in the water collection tray 11. Once the water reaches a set level, the water level sensor or switch 10 in the water collection tray sends a signal to the control unit 7 to start the vacuum pump 5. Electrical wiring is of practical reasons not shown in the figure. The pump generates vacuum in the pipe system thereby lowering the pressure in the pipe system 1. When the vacuum has reached a desired level, the discharge valve 3 for the respective refrigeration unit where the water collection tray 11 needs to be emptied, is opened by the control unit 7 and water is sucked from the water collection tray 11. As formerly stated, water may be lifted twice the height, i.e. 8-10 meters with the same vacuum and thus, an air inlet nozzle 6 (FIG. 4) is provided in the water drainage pipe 19 at the bottom of the vertical pipe section 2, enabling air to enter into the pipe and intermix with the water in the pipe. By such intermixture of air into the pipe, the fluid. i.e. the mixture of water and air, has a density that is much smaller than 1 kg/dm$^3$ making it possible to raise the fluid in the pipe to a higher level. Tests have proved that it is possible with a vacuum of 50-60 kPa (40-50% of atmospheric pressure) to raise the fluid in the tank and thereby the water to 8-10 meters. The amount of air entering the pipe can be set manually based on experience/testing, or the air inlet nozzle 6 may be controlled by the control unit 7 automatically based on measurement of a density meter in the vertical pipe section 2 (not shown) electrically connected to the control unit 7. It should, however, be noted that in systems where the water collection tray 11 is small and the amount of accumulated water is additionally small, sufficient air may enter into the water drainage pipe 19 through the holes 20 at the end of emptying operation to obtain the required water lifting height. Thus, entering of air through the air inlet nozzle 6 may in such situations not be required.

Once the water collection tray 11 is empty, the water level detector or switch sends a signal to the control unit 7 to stop the vacuum pump 5 and close the discharge valve 3. In such small system as described above, the emptying of the water collection tray 11 may even be done by just starting and stopping the pump, without using the discharge valve 3, It is however expedient to use a valve to secure proper working and avoiding return of water from the pressure side of the system.

In larger systems, were there are several different water collection trays 11 working in parallel pipe loops like the one shown in FIG. 1 where each loop is connected to a common vacuum main pipeline 1, continuous running of the pump (or pumps—depending on the system's vacuum requirement) is most common, Then, there is a set vacuum in the main pipeline and the valve opens for each tank and pipe loop when needed. The working principle is, however, the same as described above where the valve opens and closes on the basis of a signal from a water level sensor or switch 10 in the water collection tray 11. Each water drainage system may, as stated above, have a large number of refrigeration or cooling units 4 and since each water collection tray 11 has a small volume needing to be emptied frequently and the vacuum pump 5 has a maximum capacity, a failsafe control regime is needed to avoid collapse of the system, i.e. that too many discharges of water takes place at the same time. This is obtained by programming the control unit 7 such that only one water collection tray 11 is emptied at a time and within a shortest possible period of time before the emptying of the next water collection tray is started. The size of the water collection trays is custom made for each system, depending on the height or space available between the refrigeration or cooling unit 4 and floor where the system is installed. As an example, for a special delivery to a "random" customer, the water collection tray 11 has a volume of 4 litres. The time for emptying is then set to 60 seconds before emptying of the next water collection tray is started. The control unit may be a PLC (Programmable Logic Control) or other suitable control device, but will not be further described.

In some situations when the system is running over a period of time, there may be a build-up of liquid in the vertical pipe section 2 of the pipeline as the remaining water after each running of the pump is not returning to the water collection tray 11. To avoid such build-up of water in the vertical pipe section 2, an air conduit inlet opening 9 is provided at the upper part of vertical pipe section 2. The hole is so small that a minor amount of air is allowed to enter into the pipe such that the remaining water in the vertical pipe section 2, after each emptying operation, is allowed to return to the tank 4, but the vacuum in the pipe is not influenced when the pump is running.

The dimensioning of the components of a system exploiting the inventive arrangement is dependent on different parameters such as required capacity (number of refrigeration or cooling units), pipe diameters, available space and size of water collection trays, the required number vacuum pumps etc.

The invention claimed is:

1. An arrangement for accumulation and evacuation of water, the arrangement comprising:

a water evacuation unit including:

a docking station; and a water collection tray to be docked within the docking station; the water collection tray removing defrosted or condensed water from a refrigeration or cooling unit;

at least one vertical pipe extending from a suction pipe connection;

a discharge valve in communication with the vertical pipe;

a vacuum pump;

an air inlet nozzle provided in a drainage pipe at a bottom of the water collection tray;

at least one water level switch or sensor; and a control unit in communication with the at least one water level switch or sensor; the control unit operable to control the discharge valve based on a water level in the water collection tray.

2. The arrangement according to claim 1, wherein the water collection tray is slidably provided within the docking station, the docking station including upwardly protruding guide members and end stoppers for guiding and positioning of the tray within the docking station, whereby at the end of the docking station, between the end stoppers, is provided a suction pipe connection to be sealingly connected at its outer end to the vertical piping.

3. The arrangement according to claim 2, wherein a water drainage pipe is provided in a longitudinal direction of the water collection tray extending through each of an end of the tray such that an inner end of the water drainage pipe is provided to fit sealingly into the suction pipe connection when being docked in its docking station underneath the refrigeration unit, and whereby the pipe on the side facing the bottom of the tray and within the length of the tray, is provided with drainage holes through which the water is sucked into the pipe during water evacuation operation.

4. The arrangement according to claim 2, wherein a volume of the water collection tray is between 3-6 litres.

5. The arrangement according to claim 2, further comprising several additional water evacuation units, wherein the control unit is programmed such that only one water evacuation unit is activated to empty the corresponding water collection tray at a time and wherein the control unit pauses for a predetermined period of time before activating a second water evacuation unit for the emptying of a next water collection tray is started.

6. The arrangement according to claim 2, wherein an air conduit or inlet opening is provided at an upper part of each of the at least one vertical pipe.

7. The arrangement according to claim 1, wherein a water drainage pipe is provided in a longitudinal direction of the water collection tray extending through each of an end of the tray such that an inner end of the water drainage pipe is provided to fit sealingly into the suction pipe connection when being docked in its docking station underneath the refrigeration unit, and whereby the pipe on the side facing the bottom of the tray and within the length of the tray, is provided with drainage holes through which the water is sucked into the pipe during water evacuation operation.

8. The arrangement according to claim 7, wherein a volume of the water collection tray is between 3-6 litres.

9. The arrangement according to claim 7, further comprising several additional water evacuation units, wherein the control unit is programmed such that only one water evacuation unit is activated to empty the corresponding water collection tray at a time and a predetermined period of time before activating a second water evacuation unit for emptying of a next tray.

10. The arrangement according to claim 9, wherein the predetermined period of time is 60 seconds.

11. The arrangement according to claim 7, wherein an air conduit or inlet opening is provided at an upper part of the at least one vertical pipe.

12. The arrangement according to claim 1, wherein a volume of the water collection tray is between 3-6 litres.

13. The arrangement according to claim 12, further comprising several additional water evacuation units, wherein the control unit is programmed such that only one water evacuation unit is activated to empty the corresponding water collection tray at a time and a predetermined period of time before activating a second water evacuation unit for the emptying of a next tray.

14. Arrangement according to claim 13, wherein the predetermined period of time is 60 seconds.

15. The arrangement according to claim 12, wherein an air conduit or inlet opening is provided at an upper part of the at least one vertical pipe.

16. The arrangement according to claim 1, further comprising several additional water evacuating units, wherein the control unit is programmed such that only one water evacuation unit is activated to empty the corresponding water collection tray at a time and wherein the control unit pauses for a predetermined period of time before activating a second water evacuation unit for emptying of a next water collection tray.

17. The arrangement according to claim 16, wherein the predetermined period of time is 60 seconds.

18. The arrangement according to claim 1, wherein an air conduit or inlet opening is provided at an upper part of each vertical pipe.

* * * * *